US005927534A

United States Patent [19]

King et al.

[11] Patent Number: 5,927,534

[45] Date of Patent: Jul. 27, 1999

[54] SEAL FOR FLOATING ROOF OF STORAGE TANK

[75] Inventors: Richard P. King, Magnolia; Russell D. Curtiss; John R. LeBlanc, both of Houston, all of Tex.

[73] Assignee: HMT, Inc., Houston, Tex.

[21] Appl. No.: 09/082,028

[22] Filed: May 20, 1998

[51] Int. Cl.[6] ..... B65D 88/46

[52] U.S. Cl. ..... 220/224; 220/222

[58] Field of Search ..... 220/216, 222, 220/224

[56] References Cited

U.S. PATENT DOCUMENTS

| | | | |
|---|---|---|---|
| 1,892,144 | 12/1932 | Griffin | 220/224 |
| 1,992,221 | 2/1935 | Kramer | 220/222 |
| 4,099,643 | 7/1978 | Wardwell et al. | 220/222 |
| 4,258,858 | 3/1981 | Russell | 220/222 |
| 4,308,968 | 1/1982 | Thiltgen et al. | 220/222 |
| 5,078,293 | 1/1992 | Lippiello | 220/221 |
| 5,103,992 | 4/1992 | Lippiello et al. | 220/221 |
| 5,301,828 | 4/1994 | McKay | 220/221 |

*Primary Examiner*—Stephen K. Cronin
*Attorney, Agent, or Firm*—Loeb & Loeb LLP; John P. Scherlacher

[57] ABSTRACT

A seal for sealing the space between the inner wall of a tank and a roof floating on a liquid product within the tank includes a plurality of partially overlapping barrier plates mounted along a rim of the floating roof so as to extend outwardly along a first portion of each plate and then downwardly along a second portion of each plate which is relatively flat and which forms a seal against the inner wall of the tank. A plurality of resilient tension springs, mounted in spaced-apart relation along the rim of the floating roof, extend outwardly and bias the seals formed by the second portions of the plates against the inner tank wall. A vapor barrier fabric, mounted on the rim of the floating roof together with the plates and the tension springs, covers the first and second portions of the plates, while a plurality of fabric spring straps, mounted on the rim of the floating roof in conjunction with the tension springs, extend along the undersides of the plates and protect the vapor barrier fabric from the tension springs. Bumper bars, mounted in spaced-apart relation along the rim of the floating roof, extend outwardly along the first portions of adjacent ones of barrier plates to curved outer ends thereof which engage the inner tank wall to limit movement of the floating roof toward the tank wall. The barrier plates, tension springs, vapor barrier fabric and fabric spring straps are mounted on the rim of the floating roof by arrangements of bolts, washers and seals, and holddown bars which extend over adjacent pairs of the barrier plates. The barrier plates, tension springs and fabric spring straps are made of full hard stainless steel so as to retain the desired shapes thereof in resilient fashion and to better enable the relatively flat second portions of the barrier plates to conform to and seal against the inner wall of the tank.

24 Claims, 3 Drawing Sheets

SEAL FOR FLOATING ROOF OF STORAGE TANK

BACKGROUND OF THE INVENTION

1. Field Of The Invention

The present invention relates to seats for sealing the space between a floating roof and an inner tank wall within a storage tank for petrochemical or other liquid products.

2. History Of The Prior Art

It is standard practice in the field of large storage tanks such as oil storage tanks having floating roofs to provide the floating roof with a seal. Such seals act to seal the space between the outer rim of the floating roof and the inner tank wall, while at the same time allowing the floating roof to rise or drop as the height of the liquid product within the storage tank varies. Such seals are necessary in order to prevent harmful hydrocarbon vapors from escaping through the space between the floating roof and the inner tank wall and entering the atmosphere. Seals for floating roofs within storage tanks can assume a variety of different configurations. Examples of the different possible configurations of floating roof seals are provided by U.S. Pat. No. 4,308,968 of Thiltgen et al., U.S. Pat. No. 5,078,293 of Lippiello, U.S. Pat. No. 5,103,992 of Lippiello et al. and U.S. Pat. No. 5,301,828 of McKay. Such patents are commonly assigned with the present application. The seals depicted by these patents assume various different configurations, and typically utilize vapor barrier fabrics in conjunction with other materials. Several of the configurations utilize shoe seals which are suspended from the outer edge of the floating roof for disposition adjacent and biasing against the inner tank wall.

The floating roof seals described in the above-mentioned patents are capable of sealing the space between the floating roof and the inner tank wall effectively. However, there is a continuing need for floating roof seals that provide other options and alternatives in terms of design, fabrication and installation. Thus, while shoe type seals provide effective sealing arrangements, the apparatus required to suspend the shoes from the floating roof may be complex, expensive, or difficult to install. Seals of relatively simple design and low cost may present particular advantages for many installations.

It is therefore a desirable goal to provide improved floating roof seals that may offer certain advantages over existing seals. In particular, it would be desirable to provide seal designs which work in a very efficient and effective manner while at the same time providing certain advantages such as simplicity of design, low cost fabrication and ease of installation.

BRIEF DESCRIPTION OF THE INVENTION

The foregoing and other objects and features in accordance with the invention are accomplished by providing an improved seal which seals the space between the floating roof and the inner tank wall in a positive and effective manner and which at the same time is easily assembled and installed using a minimum of materials and involving relatively low cost.

Floating roof seals in accordance with the invention utilize a plurality of barrier plates which are mounted in partially overlapping fashion along the rim of the floating roof in conjunction with a vapor barrier fabric and a plurality of tension springs. Each of the barrier plates is mounted on the rim of the floating roof at a first end thereof, such as by bolting. When so installed adjacent the inner tank wall, each barrier plate extends outwardly in the direction of the inner tank wall along a first portion thereof before being deflected downwardly through a generally right angle bend to a second portion thereof. The second portions of the plates are relatively flat and form seals disposed against the inner tank wall. The vapor barrier fabric is generally coextensive with the partially overlapping barrier plates and extends from the rim of the floating roof along the undersides of the first portions of the barrier plates and then along the inner surfaces of the second portions of the barrier plates. The tension springs, which are mounted in spaced-apart relation along the rim of the floating roof, extend downwardly and then outwardly therefrom and terminate in outer ends which resiliently bias the second portions of the barrier plates against the inner tank wall. In particular, the outer ends of the tension springs are disposed adjacent upper regions of the second portions of the barrier plates to ensure engagement of the barrier plates against the inner tank wall at regions well above the level of the liquid product.

To protect the vapor barrier fabric from abrasion or other damage by the outer ends of the tension springs, the seal includes fabric spring straps which are mounted on the rim of the floating roof together with the barrier plates, the vapor barrier fabric and the tension springs so as to extend outwardly along the underside of the first portions of the barrier plates and then along the inner surfaces of the second portions of the barrier plates in the region of the outer ends of the tension springs.

The seal may include a plurality of bumper bars mounted in spaced-apart relation along the rim of the floating roof at repeating intervals. The bumper bars extend outwardly from the rim of the floating roof along the first portions of barrier plates on which they are mounted to curved outer ends of the bumper bars. The curved outer ends of the bumper bars engage the inner wall of the tank, as necessary, to prevent the floating roof from moving too close to the inner tank wall.

The barrier plates, the vapor barrier fabric, the tension springs and the fabric spring straps are mounted on the rim of the floating roof in appropriate fashion, such as by bolting. Mounting bolts are employed in conjunction with arrangements of washers and seals, and including holddown bars which are disposed over adjacent pairs of the barrier plates to facilitate the mounting thereof.

The barrier plates, the tension springs and the fabric spring straps are preferably made of material which seeks to maintain desired shapes thereof in resilient fashion. In particular, the barrier plates desirably have sufficient flexibility so as to closely conform to the shape of the inner wall of the tank and thereby form a more effective seal therewith. One such material suitable for use in fabricating such parts, including particularly the barrier plates, is full hard stainless steel. Full hard stainless steel can be fabricated so as to maintain desired shapes of the parts formed thereby in resilient fashion, and at the same time tends to conform to the inner tank wall for better sealing action.

BRIEF DESCRIPTION OF THE DRAWINGS

The foregoing and other objects, features and advantages of the invention will be apparent from the following more particular description of preferred embodiments of the invention, as illustrated in the accompanying drawings, in which.

DETAILED DESCRIPTION

Figure 1:
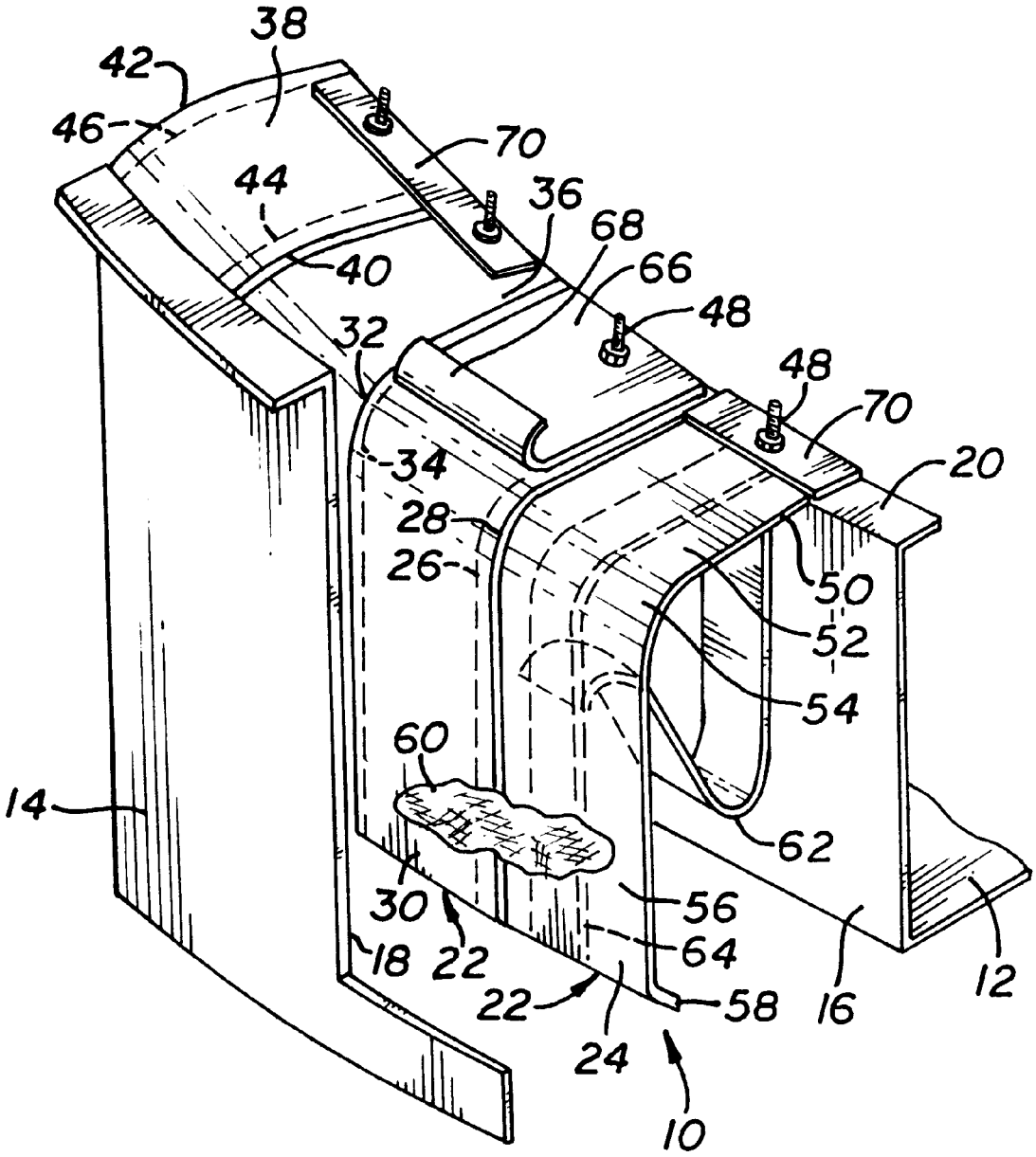
FIG. 1 is a perspective view of a portion of a storage tank together with a floating roof and having a seal between the outer rim of the floating roof and the inner tank wall in accordance with the invention.

FIG. 1 shows a seal 10 in accordance with the invention. The seal 10 is shown in conjunction with a floating roof 12 in a tank 14, and is effective to seal the space between an outer edge 16 of the floating roof 12 and an inner wall 18 of the tank 14. A portion of the tank 14 is broken away to reveal some of the details of the seal 10.

The floating roof 12 floats on a liquid product (not shown) within the tank 14. Typically, the surface of the liquid product is at a location which is approximately ¼ of the distance up the outer edge 16 of the floating roof 12 from the bottom of the edge 16. The seal 10 must seal the space between the floating roof 12 and the tank 14 above the level of the liquid product, so that harmful vapors from the liquid product cannot escape therethrough into the atmosphere above. The outer edge 16 of the floating roof 12 terminates at an upper edge thereof in a rim 20 on which the seal 10 is mounted.

The seal 10 includes a plurality of partially overlapping barrier plates 22. As seen in FIG. 1, alternate ones of the barrier plates 22 have opposite side edges which overlap the side edges of adjacent barrier plates 22 on opposite sides thereof. For example, a first one 24 of the barrier plates 22 has a side edge 26, shown in dotted outline, which is overlapped by a side edge 28 of a second one 30 of the barrier plates. The second one 30 of the barrier plates 22 has an opposite side edge 32 which overlaps a side edge 34 of a third one 36 of the barrier plates 22. A fourth one 38 of the barrier plates 22, disposed on an opposite side of the third one 36 of the barrier plates from the second one 30 of the barrier plates 22, has opposite side edges 40 and 42. The side edge 42 overlaps a side edge 44 of the third one 36 of the barrier plates 22, while the opposite side edge 42 overlaps a side edge of an adjacent one of the barrier plates 22 which is not shown in FIG. The partially overlapping barrier plates 22 are mounted on the rim 20 of the floating roof 12 by fastening arrangements which include bolts 48 and which are shown in detail in FIG. 5 described hereafter. Each of the barrier plates 22 has a first end 50 thereof mounted on the rim 20 and a first portion 52 which extends outwardly from the floating roof 12 toward the inner wall 18 of the tank 14 and which gradually curves through a generally right angle bend 54 to a second portion 56 of the barrier plate 22. The second portion 56 extends downwardly from the first portion 52, and is relatively flat so as to form a seal which resides against the inner wall 18 of the tank 14. The lower end of the second portion 56 is angled outwardly from the relatively flat configuration of the second portion 56, and forms a lip portion 58. The barrier plates 22 are made of resilient material which helps to maintain the second portions 56 thereof against the inner wall 18 of the tank 14.

The seal 10 includes a vapor barrier fabric 60 which is generally coextensive with the partially overlapping barrier plates 22 at the undersides thereof. Portions of the first and second ones 24 and 30 of the barrier plates 22 are broken away, in FIG. 1, to reveal the vapor barrier fabric 60. The vapor barrier fabric 60 is mounted between the first ends 50 of the barrier plates 22 and the rim 20 of the floating roof 12, and extends along the underside of the first portion 52 of each of the barrier plates 22, through the generally right angle bend 54, and along the surface of the second portion 56 of the barrier plates 22 opposite the inner wall 18 of the tank 14. The vapor barrier fabric 60 extends between the partially overlapping barrier plates 22 in generally continuous fashion, to prevent the escape of vapors through the overlapping portions of adjacent ones of the barrier plates 22.

The seal 10 also includes a plurality of tension springs 62. The tension springs 62 are mounted in spaced-apart fashion around the rim 20 so as to be disposed beneath alternate ones of the barrier plates 22. In the arrangement shown in FIG. 1, the tension spring 62 is disposed beneath the first one 24 of the barrier plates 22. Although not shown therein, an adjacent one of the tension springs is mounted beneath the third one 36 of the barrier plates 22. The tension springs 62, which are mounted on the rim 22 in conjunction with adjacent ones of the barrier plates 22, extend outwardly from the outer edge 16 of the floating roof 12 in a somewhat scroll-like configuration and bias the second portions 56 of adjacent ones of the barrier plates 22 against the inner wall 18 of the tank 14, particularly at upper regions of the second portions 56 above the level of the liquid product. The tension springs 62 are described in greater detail in connection with FIGS. 2 and 4.

To prevent an outer end of each tension spring 62 from abrading or otherwise damaging the vapor barrier fabric 60, each tension spring 62 is mounted in conjunction with a fabric spring strap 64. One of the fabric spring straps 64 is shown in dotted outline in FIG. 1, and it is shown and described in detail in FIG. 2. The fabric spring strap 64, which is mounted on the rim 20 by one of the bolts 48 in conjunction with an adjacent tension spring 62 and an adjacent one of the barrier plates 22, extends along the underside of the first portion 52 and along the inner surface of the second portion 56 of the adjacent barrier plate 22 on the opposite side of the vapor barrier fabric 60 from the adjacent barrier plate 22. The fabric spring strap 64 receives an outer end of the adjacent tension spring 62 to prevent abrasion or other damage to the vapor barrier fabric 60.

The seal 10 includes a plurality of bumper bars 66 mounted in spaced-apart intervals around the rim 20. FIG. 1 shows one of the bumper bars 66 mounted by one of the bolts 48 on top of the second one 30 of the barrier plates 22. As shown therein, the bumper bar 66 extends outwardly from the rim 20 along the upper surface of the first portion 52 of the second one 30 of the barrier plates 22 to a curved outer end 68 of the bumper bars 66. The curved out end 68 curves upwardly and away from the adjacent second one 30 of the barrier plates 22 in a semicircular arc, and is positioned approximately at the outer end of the first portion 52 at a location where the generally right angle bend 54 in the barrier plate begins. The curved outer end 68 of the bumper bar 66 engages the inner wall 18 of the tank 14 as necessary to limit the extent of travel of the floating roof 12 toward the inner wall 18.

The bumper bar 66 also serves to hold down the first end 50 of the adjacent one of the barrier plates 22 at the location where the first end 50 is bolted to the rim 20 by one of the bolts 48. Mounting of the intervening ones of the barrier plates 22 between adjacent pairs of the bumper bars 66 is facilitated by holddown bars 70. FIG. 1 shows one of the holddown bars 70 and a portion of a second one. Each of the holddown bars 70 is disposed over a different adjacent pair of the barrier plates 22.

Figure 2:
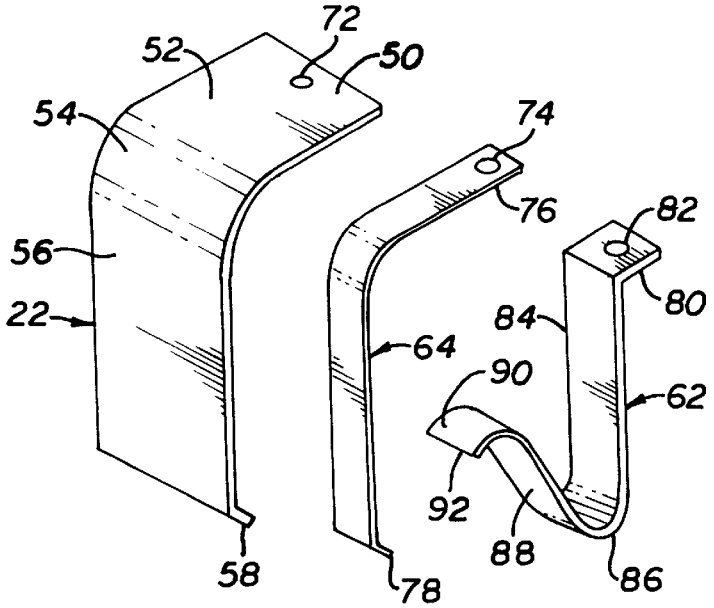
FIG. 2 is a perspective view of a barrier plate, a fabric spring strap and a tension spring used in the seal of FIG. 1.

FIG. 2 shows a barrier plate 22 in conjunction with a fabric spring strap 64 and a tension spring 62. The barrier plate 22, the fabric spring strap 64 and the tension spring 62 are spaced apart from each other in the illustration of FIG. 2, so that the details of each can be seen. Also, the barrier plate 22, the fabric spring strap 64 and the tension spring 62 are shown in the configurations they assume when mounted on the rim 20 so as to reside in the space between the rim 20 and the inner tank wall 18.

As shown in FIG. 2, the barrier plate 22 has the first end 50 thereof for mounting on the rim 20. The first end 50 is provided with an aperture 72 therein for receiving one of the bolts 48 shown in FIG. 1 to accomplish mounting on the rim 20. The first portion 52 of the barrier plate 22 extends outwardly from the first end 50 in generally planar fashion. Before mounting on the rim 20, the barrier plate 22 assumes a generally planar configuration, except for the lip portion 58 thereof which is formed in the barrier plate 22 by machine. However, when the barrier plate 22 is mounted on the rim 20 so as to be disposed in the space between the rim 20 and the inner tank wall 18, then the barrier plate 22 is deflected by the inner tank wall 18 and assumes the bent configuration shown. When in that configuration, the first portion 52 of the barrier plate 22 extends to the generally right angle bend 54, where the barrier plate 22 undergoes a gradual, generally right angle bend to the second portion 56 which extends in a downward direction. The second portion is of relatively flat configuration and forms a seal against the inner wall 18 of the tank 14. A lower end of the second portion 56 is angled outwardly at the lip portion 58, to facilitate smooth movement of the barrier plate 22 along the inner wall 18 of the tank 14.

As shown in FIG. 2, the fabric spring strap 64 has the same general configuration as the barrier plate 22, but is much narrower. Like the barrier plate 22, the fabric spring strap 64 is basically of planar configuration, except for a machine formed lip portion 78 at a lower end thereof, and assumes the curved configuration shown, when installed as part of the seal 10. Consequently, the fabric spring strap 64 is able to conform to the underside of the barrier plate 22 on the opposite side of the vapor barrier fabric (not shown in FIG. 2) therefrom. The fabric spring strap 64 has an aperture 74 in a first end 76 thereof for receipt of one of the bolts 48 when mounting in conjunction with the first end 50 of the barrier plate 22. The opposite end of the fabric spring strap 64 from the first end 76 terminates in the lip portion 78 which conforms with the inside of the lip portion 58 of the adjacent barrier plate 22.

As shown in FIG. 2, the tension spring 62 has a first end 80 thereof for mounting on the rim 20 beneath the fabric spring strap 64 and the barrier plate 22. The first end 80 has an aperture 82 therein for receiving the bolt 48. From the first end 80, the tension spring 62 undergoes a generally right angle bend and extends downwardly along a relatively straight first portion 84 thereof which is disposed adjacent the outer edge 16 of the floating roof 12, before undergoing a first bend 86 therein. From the first bend 86, the tension spring 62 extends upwardly and outwardly along a relatively straight second portion 88 thereof to a second bend 90. At the end of the second bend 90, the tension spring 62 terminates in an outer end 92 which bears against the fabric spring strap 64 as better shown and as described hereafter in connection with FIG. 4.

Prior to installation, the tension spring 62 is formed into a configuration similar to that shown in FIG. 2, but the first and second portions 84 and 88 form a larger angle at the first bend 86 than what is shown. Upon installation, however, the tension spring 62 assumes the configuration shown in FIG. 2, with the outer end 92 thereof biasing the upper region of the second portion 56 of the barrier plate 22 against the inner tank wall 18.

Figure 3:
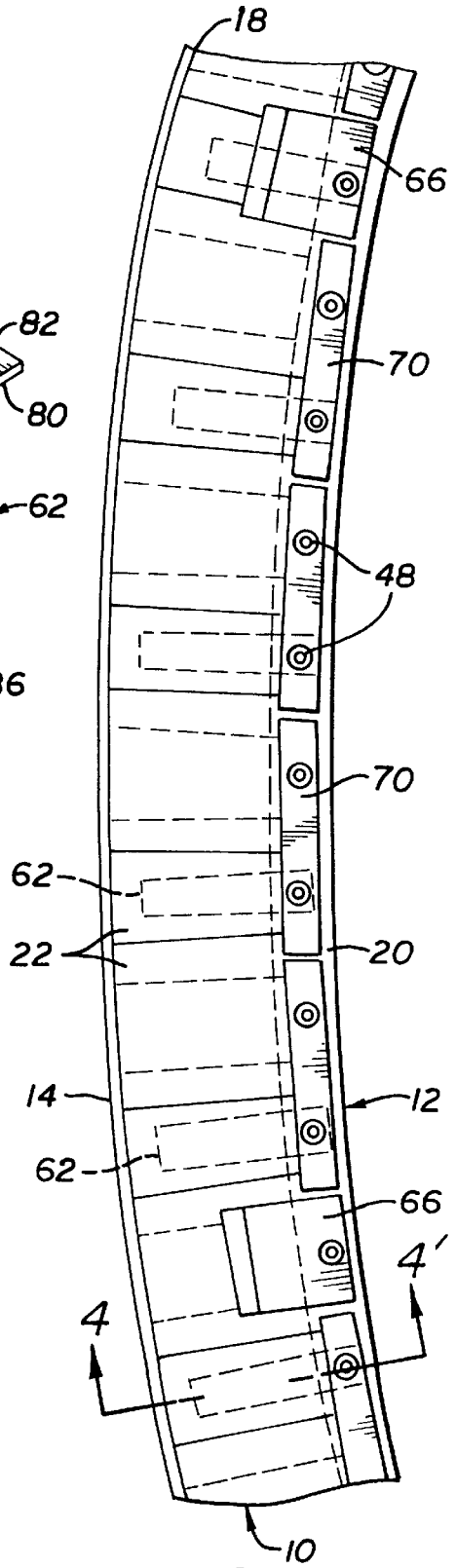
FIG. 3 is a top view of the arrangement of FIG. 1.

FIG. 3 is a top view of the seal 10 together with the rim 20 of the floating roof 12 and the tank 14. The top view of FIG. 3 shows a longer portion of the seal 10, the rim 20 and the tank 14 than does the perspective view of FIG. 1. As shown in FIG. 3, the various barrier plates 22 are mounted along the rim 22 in partially overlapping fashion. Most of the barrier plates 22 are mounted with the aid of holddown bars 70 which are disposed over adjacent pairs of the barrier plates 22. However, selected ones of the barrier plates 22 receive the bumper bars 66 instead of the holddown bars 70. As also shown in FIG. 3, alternate ones of the barrier plates 22 are provided with the tension springs 62. The tension springs 62 are shown in dotted outline line in FIG. 3.

Figure 4:
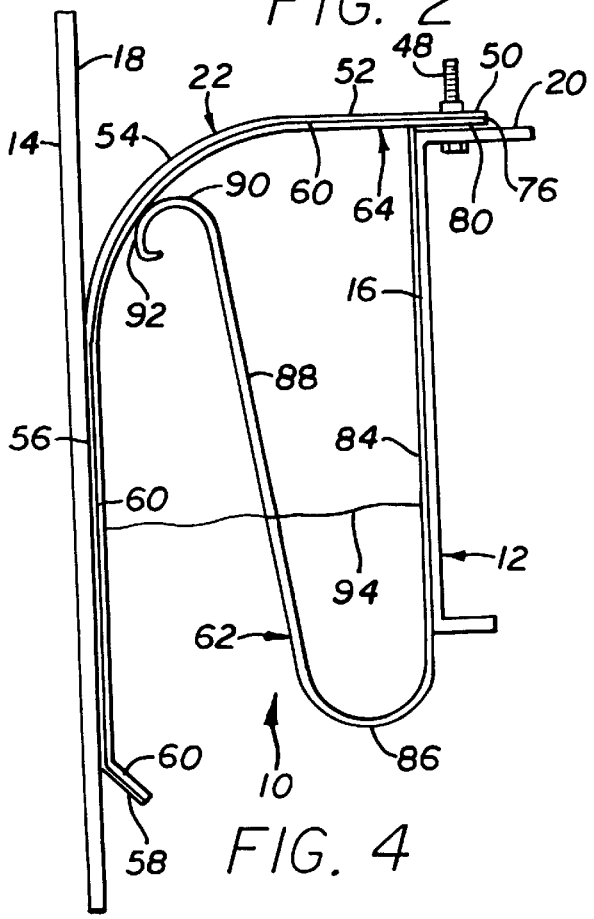
FIG. 4 is a sectional view taken along the line 4—4' of FIG. 3.

FIG. 4 is a sectional view of the arrangement of FIG. 3 taken along the line 4—4' thereof. As shown in FIG. 4, the barrier plate 22 has the first portion 52 thereof extending outwardly from the first end 50 thereof to the generally right angle bend 54. From the bend 54, the barrier plate 22 extends downwardly along the relatively flat second portion 56 thereof to the lip portion 58 at the lower end thereof. The relatively flat second portion 56 forms a seal which resides against the inner wall 18 of the tank 14. The vapor barrier fabric 60 is generally coextensive with the barrier plates 22 and extends along the underside of the first portion 52, the generally right angle bend 54 and then along the inner surface of the second portion 56 opposite the inner wall 18 of the tank 14, to the lip portion 58 at the lower end of the second portion 56. Because the vapor barrier fabric 60 is relatively thin, it appears as a line between the barrier plate 22 and the fabric spring strap 64 in FIG. 4. The fabric spring strap 64 extends from the first end 76 thereof along, the underside of the first portion 52 of the barrier plate 22, along the underside of the generally right angle bend 54, and along the second portion 56, to the lip portion 58. The fabric spring strap 64 is disposed on the opposite side of the vapor barrier fabric 60 from the barrier plate 22.

As also shown in FIG. 4, the tension spring 62 has the first end 80 thereof disposed between the first end 76 of the fabric spring strap 64 and the rim 20. The tension spring 62 extends through a right angle bend from the first end 80 and then downwardly along the relatively straight first portion 84 thereof to the first bend 86. The first portion 84 extends along the outside of the outer edge 16 of the floating roof 12. From the first bend 86, the tension spring 62 extends upwardly and outwardly along the relatively straight second portion 88 thereof, to the second bend 90. The second bend 90 terminates in the outer end 92.

As shown in FIG. 4, the outer end 92 of the tension spring 62 bears against the fabric spring strap 64 at an upper region of the second portion 56 thereof adjacent the generally right angle bend 54. Because of its resilient nature, the barrier plate 22 maintains the relatively flat, sealing second portion 56 thereof against the inner wall 18 of the tank 14. However, the biasing action of the tension spring 62 ensures that the upper regions of the second portion 56 of the barrier plate 22 remain pressed against the inner tank wall 18 in sealing engagement therewith. Typically, the surface of the liquid product is at a level represented by a wavy line 94 in FIG. 4. The action of the tension spring 62 ensures that the barrier plate 22 is pressed against the inner wall 18 of the tank 14 in sealing engagement, at portions thereof well above the level 94 of the liquid product.

Figure 5:
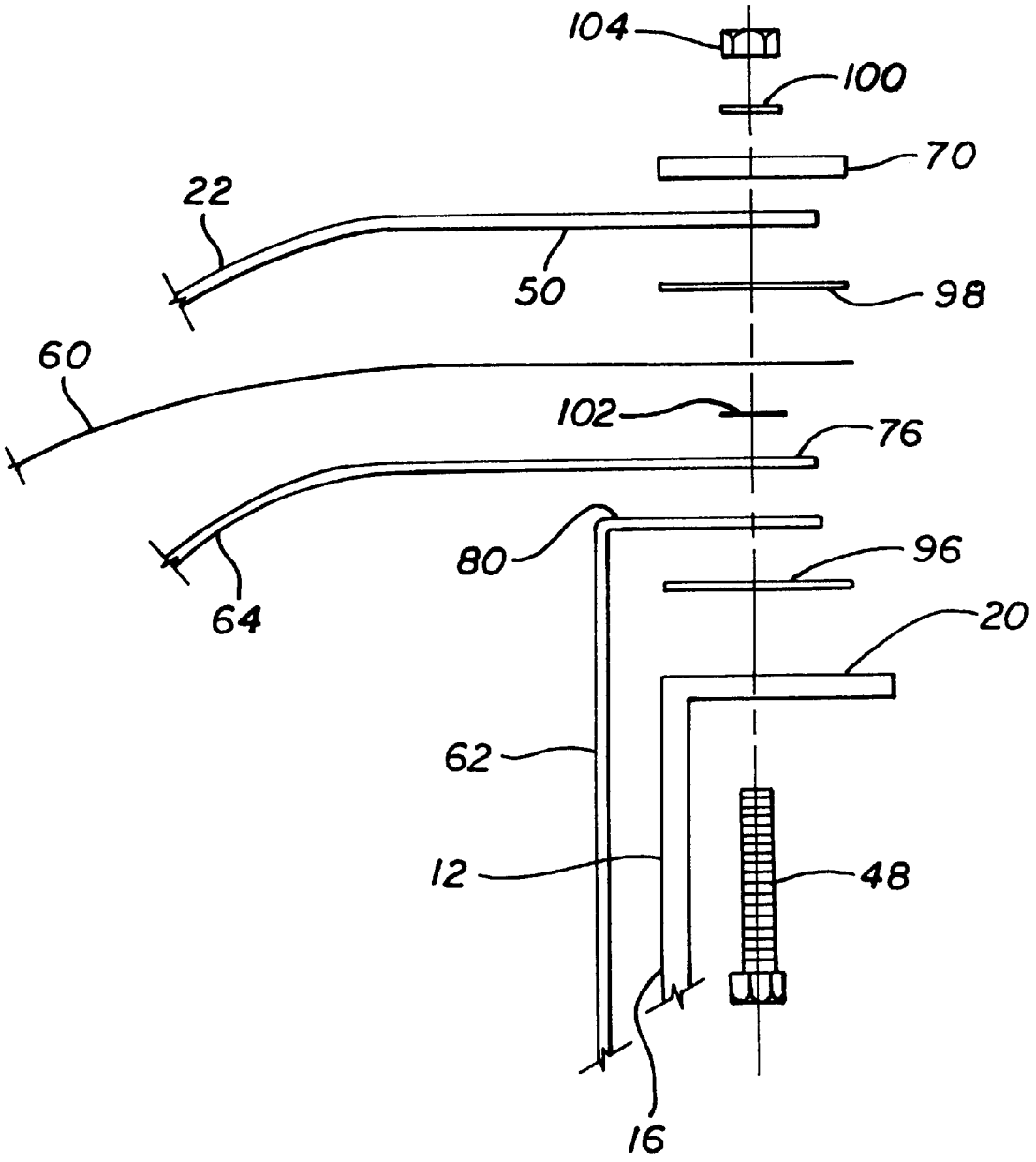
FIG. 5 is an exploded view of an arrangement for bolting the seal to the rim of the floating roof.

FIG. 5 shows a typical arrangement for bolting the various parts of the seal 10 to the rim 20 of the floating roof 12. The bolt 48 extends upwardly through an aperture in the rim 20, through a length of neosponge tape 96 and through the first end 80 of the tension spring 62. From the tension spring 62, the bolt 48 extends through the first end 76 of the fabric spring strap 64, receives a pushnut 102, extends through the fabric 60, and extends through another length of neosponge tape 98. From the neosponge tape 98, the bolt extends through the first end 50 of the barrier plate 22, through the holddown bar 70, and through a washer 100 and receives a nut 104, to complete the mounting assembly.

In accordance with the invention, the barrier plates 22, the fabric spring straps 64 and the tension springs 62 are preferably made of a material which, when formed into the desired shape, thereafter retains such shape in resilient fashion. Moreover, and in the case of the barrier plates 22, such material should be relatively flexible and compliant so as to conform closely to the shape of the inner wall 18 of the tank 14. An example of a suitable material is full hard stainless steel of the type manufactured by Precision Steel Warehouse, Inc. The bumper bars 66 and the holddown bars 70 can be made of any appropriate material such as annealed stainless steel.

While the invention has been particularly shown and described with reference to preferred embodiments, it will be understood by those skilled in the art that the foregoing and other changes in form and details may be made therein without departing from the spirit and scope of the invention.

What is claimed is:

1. For use in a tank for storing a liquid product and having a roof floating on the liquid product, an arrangement for sealing a space between the floating roof and an inner wall of the tank comprising the combination of:

a plurality of plates disposed in side-by-side fashion along a floating roof and each having a first end for mounting on a floating roof and extending outwardly from the first end along a first portion thereof to a second portion thereof of relatively flat configuration forming a seal for disposition against the wall of a tank;

a vapor barrier material mounted on and generally coextensive with the plurality of plates; and a plurality of resilient elements for mounting at first ends thereof on a floating roof together with the plurality of plates, the resilient elements extending outwardly from the first ends thereof to opposite second ends which resiliently bias the second portions of the plurality plates against the wall of a tank.

2. An arrangement in accordance with claim 1, wherein each of the plates is made of full hard stainless steel so as to resiliently maintain a desired shape and to conform to an inner wall of a tank.

3. An arrangement in accordance with claim 1, wherein the vapor barrier material comprises a vapor barrier fabric, and further including a plurality of fabric spring straps for mounting at first ends thereof on a floating roof between the plurality of partially overlapping plates and the plurality of resilient elements, the fabric spring straps extending outwardly from the first ends thereof along the surfaces of the first and second portions of the plurality of partially overlapping plates and receiving the second ends of the plurality of resilient elements.

4. An arrangement in accordance with claim 1, further including a plurality of bumper bars, each being disposed on and extending along the first portion of one of the plurality of plates from the first end of the plate to an end portion of the bumper bar which curves away from the first portion of the plate through a generally semicircular arc.

5. An arrangement in accordance with claim 1, wherein the plurality of resilient elements comprise tension springs, each having a first end for mounting on a floating roof beneath the first end of one of the plurality of plates, and extending to an opposite second end thereof disposed adjacent the second portion of the one of the plurality of plates.

6. An arrangement in accordance with claim 5, wherein each of the tension springs has a generally right angle bend therein adjacent the first end thereof so as to extend away from the first portion of one of the plurality of plates along a first portion thereof when the first end thereof is mounted together with the first end of the one of the plurality of plates on a floating roof, the first portion undergoing a substantial bend to form a second portion of the tension spring, the second portion being spaced apart from the first portion and terminating in an opposite curved end which is disposed at the second portion of the one of the plurality of plates.

7. An arrangement in accordance with claim 5, further including a plurality of fabric spring straps, each being disposed between a different one of the plurality of tension springs and one of the plurality of plates on the opposite side of the vapor barrier material from the plurality of plates and having a first end for mounting on a floating roof between the tension spring and an adjacent plate and extending along the first and second portions of the adjacent plate and disposed between the second end of the tension spring and the vapor barrier material.

8. An arrangement in accordance with claim 1, wherein each of the plates partially overlaps adjacent plates on opposite sides thereof and undergoes a gradual, approximately right angle bend between the first and second portions thereof, such that the first portion thereof is generally horizontally disposed and the second portion thereof extends generally vertically downwardly from the first portion along the wall of a tank.

9. An arrangement in accordance with claim 8, wherein alternate ones of the plurality of plates have different ones of the plurality of resilient elements mounted together therewith and with the second end of each resilient element disposed at the second portion adjacent the right angle bend in the one of the plurality of plates with which it is mounted.

10. An arrangement in accordance with claim 8, wherein each of the plates has opposite side edges along the first and second portions thereof which overlap side edges of adjacent plates on opposite sides thereof.

11. An arrangement in accordance with claim 10, wherein each of the plates has a lip portion at a lower end of the second portion opposite the first portion which is angled outwardly relative to the relatively flat second portion.

12. An arrangement in accordance with claim 1, further including a plurality of holddown bars, each being disposed over the first ends of at least two of the plurality of plates to facilitate mounting of the plates on a floating roof.

13. An arrangement in accordance with claim 12, further including a plurality of bumper bars mounted on selected ones of the plurality of barrier plates by bolts extending through the bumper bars, the selected ones of the plurality of barrier plates, the first ends of the tension springs and the outer rim of the roof.

14. An arrangement in accordance with claim 13, wherein each of the bumper bars extends outwardly from the outer rim over the first portion of an adjacent barrier plate and curves upwardly through a generally semicircular arc at an outer end thereof.

15. An arrangement in accordance with claim 13, further including a plurality of holddown bars, each being disposed between an adjacent pair of the bumper bars and being mounted on adjacent ones of the plurality of barrier plates by bolts extending through the holddown bar, the adjacent ones of the plurality of barrier plates and the outer rim of the roof.

16. A storage tank arrangement comprising the combination of:

a generally cylindrical tank having an inner wall;

a generally circular roof for floatation on a liquid product in the tank and having an outer rim;

a plurality of barrier plates mounted along the outer rim of the roof in partially overlapping fashion, each of the plates extending outwardly from the outer rim along a first portion thereof to a relatively flat second portion thereof which extends downwardly from the first portion and is disposed at the inner wall of the tank;

a vapor barrier fabric extending outwardly from between the plurality of barrier plates and the outer rim of the roof and being generally coextensive with the barrier plates; and a plurality of tension springs spaced apart along the outer rim of the roof and each having a first end mounted between one of the plurality of barrier plates and the outer rim and extending to a second end thereof which resiliently biases the second portion of the barrier plate against the inner wall of the tank.

17. An arrangement in accordance with claim 16, wherein the plurality of tension springs are disposed beneath alternate ones of the plurality of barrier plates.

18. An arrangement in accordance with claim 16, wherein each of the plurality of tension springs has a generally right angle bend therein between the first end thereof and a first portion thereof which extends generally downwardly along the outer rim of the roof and then outwardly through a first curved portion to a second portion of the tension spring which extends upwardly and away from the outer rim of the roof to a second curved portion which is disposed at an upper region of the second portion of an adjacent barrier plate adjacent the first portion of the adjacent barrier plate.

19. An arrangement in accordance with claim 16, further including a plurality of fabric sing straps, each being disposed between a different one of the plurality of tension springs and an adjacent one of the plurality of barrier plates and extending along an underside of the first portion of the barrier plate and an inside surface of the relatively flat second portion of the barrier plate adjacent the second end of the tension spring.

20. For use with a floating roof seal for sealing a space between the inner wall of a tank and a roof floating on a liquid product within the tank, the combination of:

a barrier plate of integral, one-piece construction and having a first end for mounting on a floating roof and a generally planar first portion extending outwardly from the first end, the barrier plate being resiliently deflectable through a curved portion at an opposite end of the first portion from the first end to a second portion extending from the curved portion and forming a seal for disposition against an inner wall of a tank; and a tension spring having a first end for mounting on a floating roof together with the first end of the barrier plate and extending to an opposite second end adjacent the second portion of the barrier plate, the tension spring being of resilient material so that the second end thereof biases the second portion of the barrier plate against the inner wall of a tank when the tension spring and the barrier plate are mounted on a floating roof.

21. An arrangement in accordance with claim 20, wherein the barrier plate is made of full hard stainless steel.

22. An arrangement in accordance with claim 20, wherein the tension spring has a generally right angle bend therein between the first end thereof and a first portion thereof which extends downwardly and then outwardly through a first curved portion to a second portion of the tension spring which extends upwardly and away from the first portion to a second curved portion which terminates in the second end thereof.

23. An arrangement in accordance with claim 20, further including a fabric spring strap for mounting on a floating roof together with and between the first end of the barrier plate and the first end of the tension spring, the fabric spring strap extending along an underside of the first portion of the barrier plate, and being deflectable so as to extend along the curved portion of the plate and along a side surface of the second portion of the barrier plate adjacent the second end of the tension spring.

24. An arrangement in accordance with claim 20, wherein the second portion of the barrier plate is relatively flat and has a lip portion at a lower end thereof which is angled outwardly from the relatively flat second portion.

* * * * *